United States Patent [19]

Svensson

[11] 4,132,276

[45] Jan. 2, 1979

[54] ARRANGEMENT FOR FORMING VERTICAL OR STEEPLY INCLINED SHAFTS

[75] Inventor: Torbjörn Svensson, Skelleftea, Sweden

[73] Assignee: Linden-Alimak AB, Skelleftea, Sweden

[21] Appl. No.: 763,823

[22] Filed: Jan. 31, 1977

[30] Foreign Application Priority Data

Feb. 12, 1976 [SE] Sweden ..... 7601571

[51] Int. Cl.[2] ..... E21C 23/00

[52] U.S. Cl. ..... 173/1; 173/43; 175/53; 299/10

[58] Field of Search ..... 173/1, 35, 43, 52; 175/53; 299/10, 18, 70

[56] References Cited

U.S. PATENT DOCUMENTS

| | | | |
|---|---|---|---|
| 2,143,848 | 1/1939 | Gilman | 173/52 X |
| 2,176,885 | 10/1939 | Cadwallader | 173/43 X |
| 2,373,276 | 4/1945 | Thornley | 299/18 X |
| 2,731,235 | 1/1956 | Dellner | 173/52 X |
| 2,823,899 | 2/1958 | Bain | 299/10 X |
| 2,980,372 | 4/1961 | O'Leary | 173/52 X |
| 3,085,794 | 4/1963 | Johansson et al. | 299/10 X |
| 3,113,627 | 12/1963 | Ginocchio | 299/10 X |
| 3,302,976 | 2/1967 | Grant | 299/10 X |
| 3,305,272 | 2/1967 | Zhadaev et al. | 299/18 X |
| 3,471,888 | 10/1969 | Grant et al. | 299/70 X |

FOREIGN PATENT DOCUMENTS

| | | | |
|---|---|---|---|
| 613011 | 1/1961 | Canada | 299/10 |
| 1022537 | 1/1958 | Fed. Rep. of Germany | 299/10 |
| 106371 | 2/1875 | France | 173/43 |
| 1005608 | 4/1952 | France | 173/35 |
| 674 of | 1881 | United Kingdom | 173/52 |
| 836705 | 6/1960 | United Kingdom | 299/18 |

*Primary Examiner*—Lawrence J. Staab

[57] ABSTRACT

A stopping apparatus is suspended in a pilot shaft and blasting charge holes are drilled outwardly and downwardly from successive vertical positions from the bottom to the top of the pilot shaft to provide a circular array of holes fanned-out from each vertical position. The blasting charge holes are loaded with blasting charges, and detonated, proceeding from the bottom to the top of the pilot shaft.

10 Claims, 5 Drawing Figures

88
86
92
2
72
74
44
78
80
82
76
96
42
84
40
46
36
56
38
97
71
99
52
60
62
58
48
68
54
8
94
64
66
70
4
98
6

Figures 3, 4:
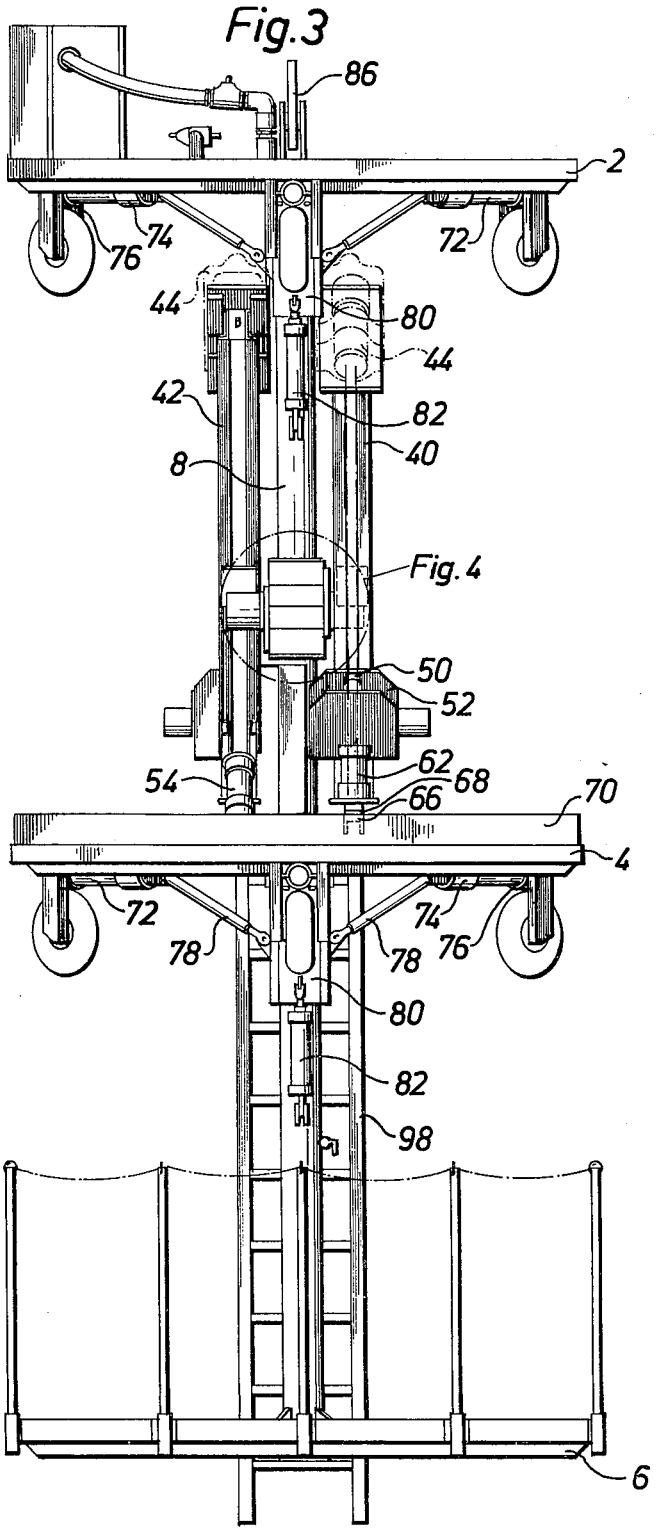

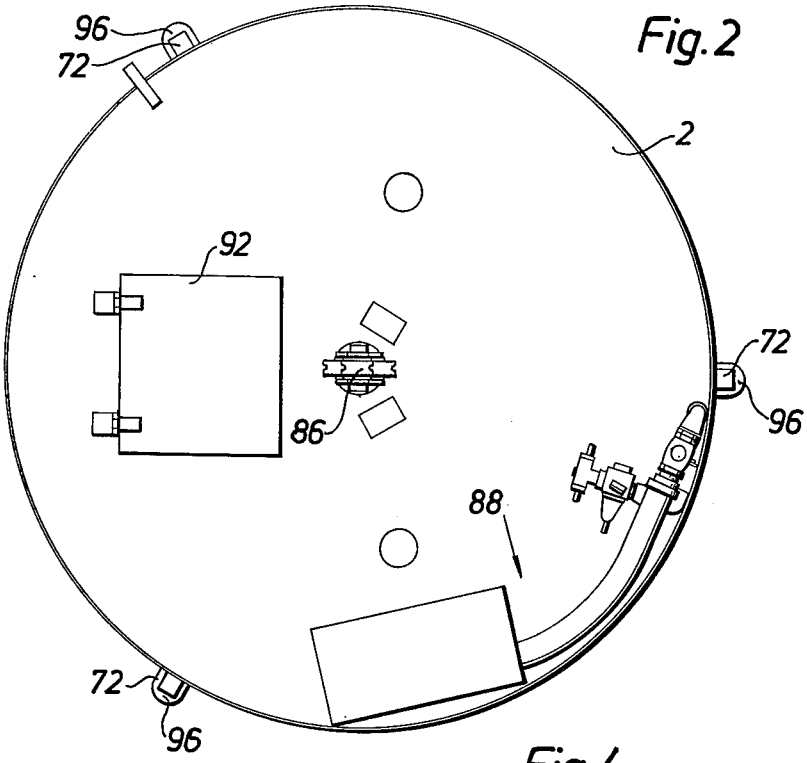
Fig. 2
Fig. 4
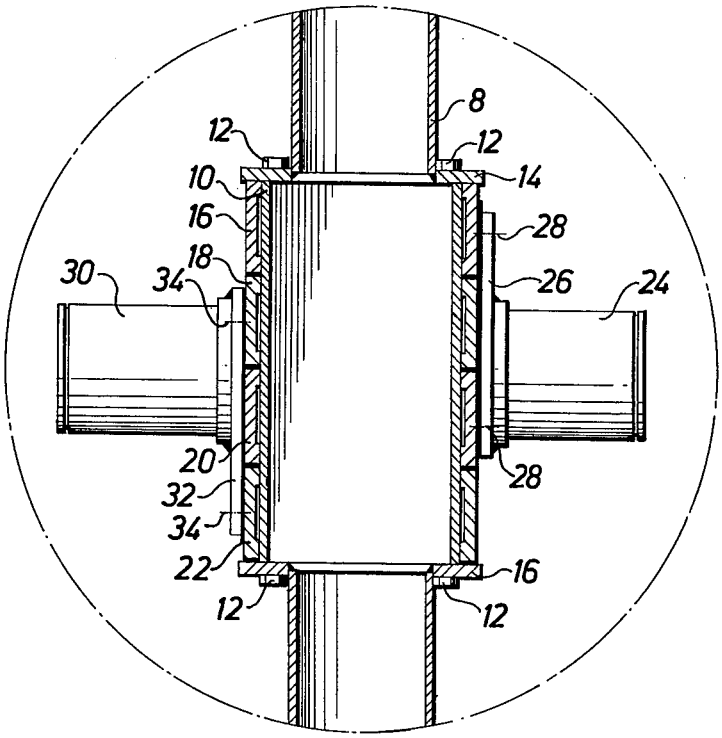

86
2
76
74
72
44
80
44
42
82
40
8

50
52
54
62
68
66
70
4
72
74
78
78
76
80
82
98
6

ARRANGEMENT FOR FORMING VERTICAL OR STEEPLY INCLINED SHAFTS

The present invention relates to an arrangement for widening and vertical or steeply inclined shafts, comprising a liftable and lowerable unit, with means for fixing the unit on a desired working level in a shaft, at least one drill with a corresponding feeder rail and means carrying the feeder rail, including means for adjusting it to different angular or turning positions around an essentially central axis, extending essentially in the direction of movement of the unit.

A method of widening and forming vertical shafts with the aid of liftable and sinkable platforms, so called stoping platforms or stoping units, has become common, and is expected to have increasingly higher importance as it becomes more frequent to drill shafts of small dimensions with so called "full-section" machines. The stoping is conventionally carried through from upwards by drilling and blasting, the drill holes being directed vertically or almost vertically. The disadvantage of working from the top downwards is that the staff must work under newly worked walls which therefore as a safety measure have to be thoroughly trimmed to remove all loose stone blocks. The method furthermore inherently results in a relatively small range sidewards. Thus, in an earlier known stoping unit, the drill feeders and drills are carried peripherally with respect to the platform by telescopic arms. The radius of the shaft that can be stoped depends upon the length of these telescopic arms, and said length must in turn be proportional to the size of the platform.

One object of the invention is to provide a stoping unit eliminating disadvantages of the kind mentioned above.

The arrangement according to the invention is characterized in that, in a plane extending transversely to the said central axis, the feeder rail in its different turning positions has corresponding projections passing essentially centrally through the total projection of the unit in the same plane.

The stoping unit according to the invention allows for an entirely new stoping method, in which the unit as a first step is lowered to the bottom of the pilot shaft and the stoping work is carried through from below and upwardly. The pilot shaft which can either be drilled by means of a full-section machine or alternatively be driven by the aid of a raise lift, has limited dimensions and requires therefore trimming to a relatively small extent. Instead of drilling vertically or almost vertically, the holes are drilled in a direction outwardly from the unit, i.e. either horizontally or preferably directly obliquely downwards-outwards, in horizontal hole circles. Due to the fact that the drill and drill feeders in the arrangement according to the invention are centrally mounted, the drill steels can easily be lengthened, by joining end to end, so that it is possible to stope from a small pilot shaft a shaft of considerable dimensions.

Drilling of the holes obliquely downwards-outwards implies certain advantages as compared with horizontal drilling. A smaller "tightness of the rock" is obtained which means that less blasting agents are required for loosening the rock. The oblique positioning of drills and feeders furthermore implies that longer drill steels can be used, implying less joints and thus faster drilling. Furthermore, the oblique positioning allows for turning movement of the feeders relatively to each other. They need not e.g. be moved simultaneously to new drilling positions but one of the machines can operate a number of holes before the other.

The working method described makes possible, if desired to finish the drilling of all hole circles, whereupon beginning from below, a number of hole circles are successively loaded and blasted.

Figure 1:
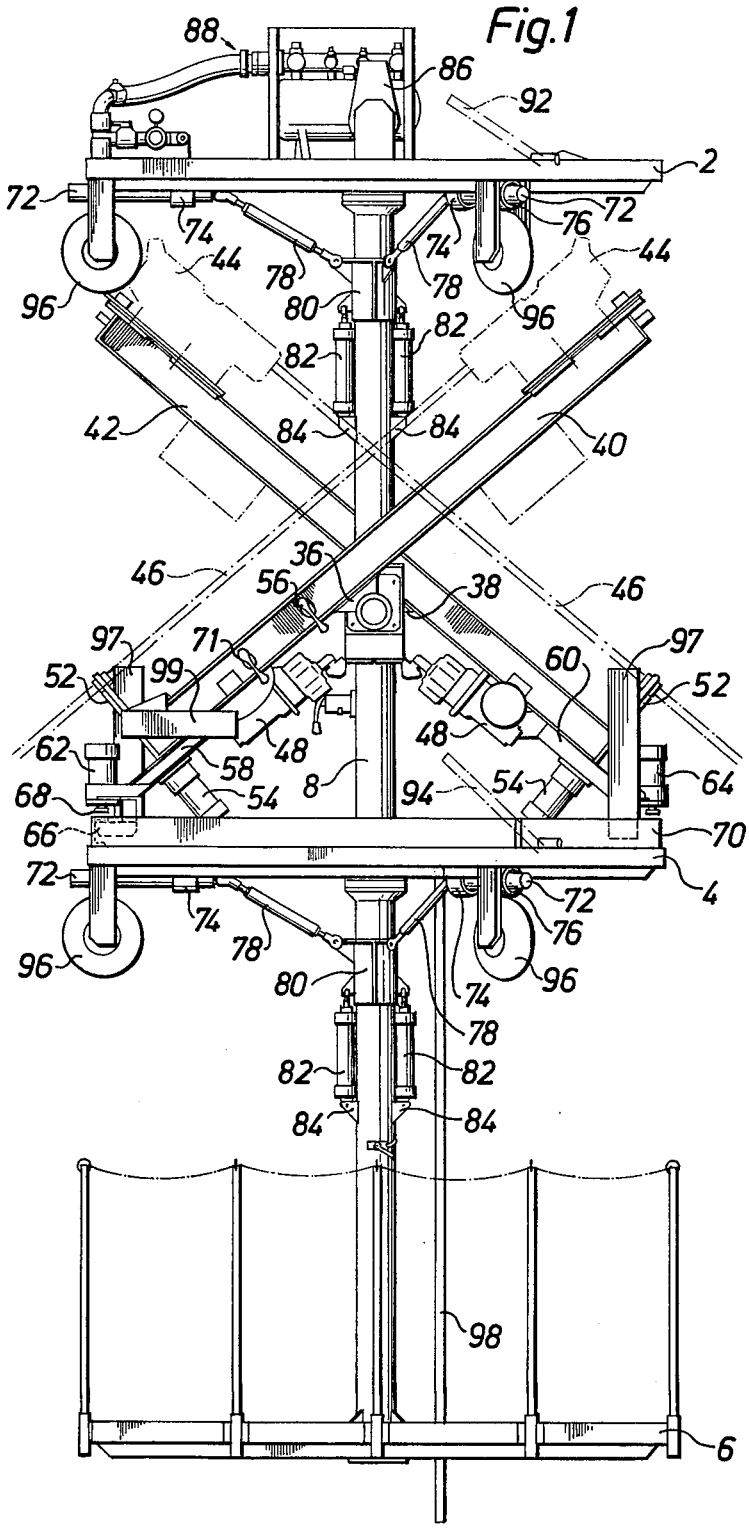
Figure 5:
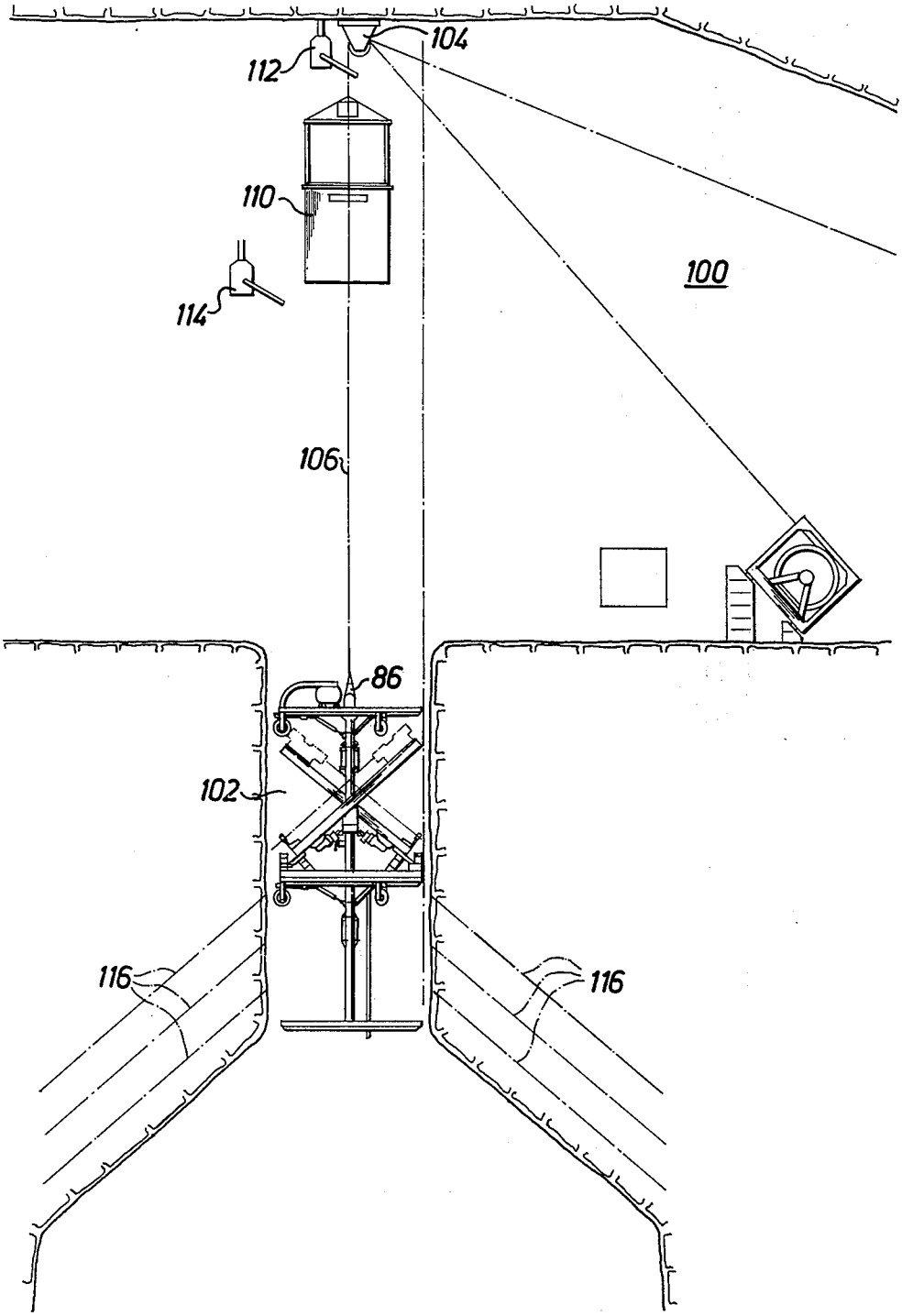

The invention shall now be described more closely below with reference to the drawings, on which FIG. 1 illustrates the arrangement in a side view, FIG. 2 illustrates a plan view of the arrangement, FIG. 3 illustrates a view perpendicular to the view of FIG. 1, FIG. 4, partly in section, illustrates a view in an enlarged scale of a detail in FIG. 3, with some parts removed, and FIG. 5 schematically and in a side view illustrates a method for using the arrangement.

The stoping unit shown on the drawings comprises three platforms 2, 4 and 6 arranged above each other. The platforms are mutually fixed to each other by means of a central pillar 8.

Referring to FIG. 4 the pillar 8 comprises between the platforms 2 and 4 a sleeve shaped portion 10 with greater diameter concentrically arranged with respect to the pillar. More exactly the sleeve 10 is clamped by means of bolts 12 between annular flanges 14 and 16 of the pillar 8. On the sleeve 10 four bushings 16, 18, 20 and 22 are rotatably journalled between the flanges 14 and 16. A pin 24 extending perpendicularly to the pillar 8 is, by means of a flange 26 and bolt joints indicated at 28, connected to the bushings 16 and 20. In the same way a pin 30 extending perpendicularly from the pillar 8 on the same level as the pin 24 is, by means of a flange 32 and bolt joints indicated at 34, connected to the bushings 18 and 22.

The pins 24 and 30 carry by means of a flange joint each, indicated at 36 and 38, respectively in FIG. 1, a drill feeder rail 40 and 42, respectively. The drill feeder rails carry in a conventional way each a drill 44 with drill steel 46 and a motor 48 for chain driving of the drill 44 along the drill feeder rail 40. The drill steel 46 is supported at the front end of the rail in a guide hole 50 of a two part support 52. The support 52 can be opened by means of a mechanism operated by a jack 54. By opening the support 52 demounting of the drill steel sidewardly is made possible. 56 is a control valve for the drill support. The construction of elements 40 - 56 can be conventional and well known to the man of the art. They need not therefore be described more closely here.

On the underside of each of the feeder rails 40 and 42, at their fore end, a girder 58 and 60, respectively is attached. Each girder carries a feeder rail lock cylinder 62 and 64, respectively. Furthermore each girder 58 and 60 carries an L-shaped locking element 66 intended to cooperate with the piston 68 (shown to the left in FIG. 1) of the corresponding lock cylinder. Around the periphery of the platform 4 a U-shaped girder 70 extends, the upper flange of which is clamped between the piston 68 and the locking element 66 to clamp the corresponding feeder rail in a set working position. 71 is a control valve for controlling the locking of the feeder rail.

Each platform 2 and 4 carries jacks for fixing the unit on a desired level in a shaft. These elements include at each platform around the periphery of the platform regularly distributed locking pistons 72, which are horizontally slidable in two sleeves 74 and 76 attached to the underside of the platform. The locking pistons 72 are connected at their inner ends by means of rods 78 articulated to a sleeve 80 movable along the pillar 8. The sleeve 80 is manoeuvrable by means of hydraulic jacks 82 acting against fixed supports 84 on the pillar 8. By moving the sleeves 80 upwardly by means of the jacks 82 the locking pistons 72 are displaced outwardly, via the rods 78, into engagement with the shaft wall.

The platform 2 carries on its upper side a cable attachment device 86 and miscellaneous auxiliary equipment such as a lubricating central indicated at 88. Said equipment which is used for drivng the drills, the jacks, and the other members and devices described above, can be of a type wellknown to the man of the art and need not therefore be described more closely here. Each platform 2 and 4 carries a door 92 and 94, respectively, through which the staff can climb up and down to the respective platforms. Furthermore the platforms 2 and 4 each carry three regularly distributed wheels 96 around the periphery thereof and serving as supports against the shaft wall. From the platform 4 a ladder 98 extends down to the platform 6, from which later loading of drill holes is intended to take place. At 97 a drill steel stand is indicated, and at 99 a tool box.

From the above it should be evident that the suspension or mounting of the feeder rails 40 and 42 can be so defined that the rails, in their different turning positions, and independent of their inclination, have corresponding geometric projections upon a plane extending transverse to the pillar 8, which pass essentially centrally through the geometric projection of the entire unit upon the same plane. In the embodiment described above the projections of the feeder rails thus pass essentially centrally through the projections of the platforms 2–6 on such a plane.

In the embodiment disclosed the inclination of the feeder rails is normally intended to be fixed. The intention is, however, that said inclination in some practical embodiments may be allowed to be varied between an essentially horizontal position and a declined position by turning the feeder rails on the pins 24 and 30. Locking of the feeder rails in a set working position in such embodiments can be carried through by means of similar elements that have been described above, i.e. elements 62 - 68, although they then have to act against a stop settable up and down over the plane of the platform 4 instead of acting against the upper flange of the girder 70. In such an embodiment, the girders 58 and 60 can be adjustable along their respective feeder rails to compensate for the arcuate movement of the fore end of the feeder rails during the turning movement thereof.

A stoping method made possible by means of a stoping unit of the kind described above shall now be described while referring to FIG. 5. From an underground cavity 100 a pilot shaft 102 has been driven, either by drilling by means of a full section machine or driving by means of a raise lift. Said pilot shaft shall now be widened. For this purpose the stoping unit is suspended from the top of the underground cavity 100, as indicated at 104, on a cable 106. The cable 106 is attached to the stoping unit by means of the attachment device 86. The cable 106 is drivable by means of a cable drive 108. At 110 a rescue basket has been indicated, and at 112 and 114 stop limit switches for the rescue basket and the stoping unit, respectively, are arranged.

Beginning at the bottom of the pilot shaft 102 holes 116 are now drilled from the stoping unit directed obliquely downwards-outwards in circles at successively higher levels. The drill steels can be lengthened by joining to obtain a desired length of the drill holes and thereby desired dimensions of the shaft. With the stoping unit described above the suspension arrangement for the feeder rails allows for a relative turning or pivoting movement of them amounting to approximately ±30°, implying that the two drills are partly independent of each other. They need e.g. not be moved simultaneously to new drilling positions but one drill can operate up to two holes before the other one. Loading of the hole circles can take place successively as the drilling work proceeds, or one can also complete the drilling of all hole circles and then, beginning from below, successively load a number of hole circles and blast.

The invention is not limited to the arrangement described above only as an embodiment, but can be further modified within the scope of the claims. Thus, other forms of suspension than a central one are possible for the mounting of the feeder rails 40 and 42. The feeder rails can e.g. be suspended by the aid of more peripheral means than a central pillar. The way of mounting illustrated and described is, however, very advantageous due to its simplicity. The section of the unit, being circular in the embodiment disclosed, can, of course, be adapted to the intended field of application, i.e. the section of the pilot shaft used. The unit is furthermore not necessarily bound to stoping of vertical shafts but can also be used for steeply inclined shafts.

What is to be claimed is:

1. An arrangement for widening vertical or steeply inclined shafts, comprising a liftable and lowerable unit, with means for fixing the unit on a desired working level in a shaft, at least one drill with a corresponding feeder rail, and means carrying the feeder rail, including means for adjusting it to different angular positions around an essentially central axis, extending essentially in the direction of movement of the unit, said feeder rail having a length dimension substantially similar to the greatest dimension of the unit transverse to said central axis to accommodate long drill steels and extensions thereof, and said feeder rail being carried by said carrying means to be positioned in working positions such that the geometrical projections of said feeder rail in its different angular positions upon a plane transverse to said central axis pass through the central region of the projection of the entire unit upon the same plane.

2. An arrangement according to claim 1, wherein the feeder rail in its different angular positions is also adjustably pivotable between a position extending essentially parallel to said plane, and a position declining obliquely downwards.

3. An arrangement according to claim 1 wherein said means carrying the feeder rail comprise a pillar extending along the central axis, and means rotatably suspending the feeder rail on said pillar for movement to the different angular positions around the pillar.

4. An arrangement according to claim 3, including means for moving said feeder rail to different declinations on said suspension means.

5. An arrangement according to claim 1 wherein said fixing means include jacks positioned above and below the feeder rail for engagement with the shaft wall.

6. An arrangement according to claim 5, wherein the jacks are located on upper and lower platforms.

7. An arrangement according to claim 1 including two drills with two feeder rails.

8. An arrangement according to claim 7 wherein said feeder rails are adjustable to different angular positions about said central axis independently of each other.

9. An arrangement as claimed in claim 3 wherein
said feeder rail is suspended essentially centrally between its ends, and wherein
said unit includes means near the periphery thereof for supporting the forward end of said feeder rail.

10. A method for cutting vertical or steeply inclined shafts for excavation comprising the steps of
excavating a small pilot shaft,
and then enlarging the pilot shaft from the bottom up by drilling outwardly and downwardly through the walls of the pilot shaft to provide a series of holes fanned out in a circle from each of a series of successively higher positions from the bottom of the pilot shaft,
loading said sets of holes with blasting charges,
and successively detonating the charges at successive vertical positions proceeding from the bottom up.

* * * * *

UNITED STATES PATENT AND TRADEMARK OFFICE

CERTIFICATE OF CORRECTION

PATENT NO. : 4,132,276

DATED : January 2, 1979

INVENTOR(S) : Torbjörn Svensson

It is certified that error appears in the above-identified patent and that said Letters Patent are hereby corrected as shown below:

Abstract of the Disclosure, line 1, "stopping" should read --stoping--.

Column 1, line 6, cancel "and" after "widening";
line 40, insert "geometrical" before "projections";
line 53, "directly" should read --directed--;
line 67, before "turning" insert --a--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*